United States Patent [19]

Satzger et al.

[11] Patent Number: 4,698,957

[45] Date of Patent: Oct. 13, 1987

[54] METHOD OF CONTROLLING A ROVING MACHINE HAVING A DECENTRALIZED DRIVE SYSTEM

[75] Inventors: Viktor Satzger; Volker Guhr, both of Grossenhain; Gerhard Laux, Karl-Marx-Stadt, all of German Democratic Rep.

[73] Assignee: VEB Kombinat Textima, Karl-Marx-Stadt, German Democratic Rep.

[21] Appl. No.: 822,190

[22] Filed: Jan. 24, 1986

[30] Foreign Application Priority Data

Jan. 25, 1985 [DD] German Democratic Rep. ..... 2727577

[51] Int. Cl.[4] ..... D01H 1/26; D01H 1/04

[52] U.S. Cl. ..... 57/96; 57/93; 57/264

[58] Field of Search ..... 57/264, 265, 93–99

[56] References Cited

U.S. PATENT DOCUMENTS

| | | | |
|---|---|---|---|
| 3,892,064 | 1/1975 | Araki et al. | 57/96 |
| 4,134,253 | 1/1979 | Handa et al. | 57/96 |
| 4,254,615 | 3/1981 | Grupp | 57/96 |
| 4,375,744 | 3/1983 | Briner et al. | 57/96 |
| 4,467,592 | 8/1984 | Araki | 57/96 |
| 4,467,593 | 8/1984 | Araki | 57/96 |

*Primary Examiner*—Donald Watkins
*Attorney, Agent, or Firm*—Nolte, Nolte and Hunter

[57] ABSTRACT

A method of controlling a roving frame to produce good quality results with fewer procedural interruptions and without knowing precise parameters of the textile material being processed. To this end, optimum roving tension during the laying down of each roving layer on a bobbin is successively determined from nominal values for bobbin rotational speed based on only a one-time estimate of material parameters.

3 Claims, No Drawings

METHOD OF CONTROLLING A ROVING MACHINE HAVING A DECENTRALIZED DRIVE SYSTEM

FIELD OF THE INVENTION

The present invention relates to the numerical control of a roving machine and is usable in the manufacture of textile machines.

BACKGROUND OF THE INVENTION

In this field, a technique has been disclosed in DD-WP D 01 H 2570 966 and is based on utilizing roving tension and on regulating the drives of bobbins, stretching mechanisms and flyers, singly or in combination, to achieve optimum roving tension. Nominal rotational speed values are calculated on the basis of known material parameters having inadequate exactness and result in a faulty roving tension which remains constant during the time period of the regulating procedure. A sacrifice of quality occurs during this period. This shortcoming is apparent at each layer whereat the difference to be regulated increases, in accordance with technical laws, with each winding layer during the runs of the bobbin. With each new layer and with each new bobbin run, the adjustment of the drives starts anew in accordance with the roving tension, which causes a loss of quality and irregularities in the material.

SUMMARY OF THE INVENTION

The object of the invention is to provide a method which permits production, in a roving machine having a decentralized drive system, of continuous good quality without the requirement of additional time for determining parameters or for starting procedures and without exact knowledge of characteristics which distinguish the yarn or thread.

The invention is based on the problem to produce bobbin rotational speeds for optimum roving tension on the basis of an only one-time estimate of material parameters, and to avoid quality defects caused by faulty roving tension during the first bobbin run and during further bobbin runs involving the same material, while maintaining constant twisting of the roving.

According to the invention, the problem is solved by adding, in production periods with uniform bobbin diameter and, therefore, within each established layer, a calculated control quality to the nominal value of the layer-dependent bobbin rotational speed and prescribing the sum as the new nominal value, then adding the difference between the latest new nominal value and the layer-dependent rotational speed nominal value of that winding layer to the layer-dependent bobbin rotational speed nominal value of the next winding layer, and storing away this sum as the new layer-dependent bobbin rotational speed nominal value of the next winding layer, and storing the latest new nominal value of that layer as the new layer-dependent bobbin rotational speed nominal value of that layer.

Furthermore, it is preferred, during subsequent pull-offs with the same material, to use the layer-dependent nominal values of the bobbin rotational speed which were calculated during the last pull-off.

It is further preferred to calculate and store away, for each winding layer, a nominal value for the bobbin carriage traverse speed which is associated with the last new nominal value of the bobbin rotational speed. The present invention makes it possible for the roving process to be continued, without requiring additional time for parameter determination and starting procedures, while producing good quality with nominal bobbin rotational speed values determined on the basis of estimated material parameters, and to maintain the good quality during the entire production process with the same material.

DETAILED DESCRIPTION OF THE INVENTION

The invention will now be described with reference to an illustrative embodiment thereof.

During the implementation of the roving process with a decentralized drive system, the coordination of the movement of the individual drives for achieving a constant tension draft is effected via nominal speed values which are supplied to the regulators of the individual drives for bobbins, bobbin carriage, flyers and stretching mechanisms. However, the calculation of these nominal speed values can, at first, be effected only on the basis of parameters which are not exactly known or whose exact determination requires considerable time. The thus resulting inexact nominal speed values for the drives of the bobbins and the bobbin carriage are calculated together with the exactly known nominal speed values for the stretching mechanisms and the flyers in the initiating phase of the controls and stored in a memory, for each winding layer.

The required exact coordination of the speeds with each other is a function of the bobbin diameter which changes during the winding and for which no exact quantitative model can be formulated, due to the multiplicity of the effective influencing factors. An important criterium for roving quality is a constant (regular) tension state of the right magnitude within the roving or slubbing. This tension state, which is at first based on inexact nominal speed values, will usually be non-optimum without touching upon substitute quantities, such as the thickness of the roving or the sagging of the roving. In a regulating device, regulated quantity increments are produced from these substitute quantities and are analytically interconnected with the nominal speed value of the bobbin drive until the optimum roving tension is achieved. The thus determined nominal speed value of the bobbin drive, associated with the optimum roving tension, is entered into the memory at the end of the respective winding layer to which it appertains, in substitution for the former inexact value. On the basis thereof, associated optimum nominal speed values are calculated and stored for the drive of the bobbin carriage. This process is repeated for each winding layer. Since, due to the calculation command, the error of the original nominal speed values for the bobbin drive changes constantly from winding layer to winding layer and its sign digit (plus-minus) remains constant for the entire winding process, the difference between the original and corrected speed values for one winding layer is added to the nominal speed value for the following winding layer, prior to the unwinding process. This reduces the number of necessary correction steps and the time required for the correction process per layer. The optimum state of the roving tension is obtained quicker, and even during the first pull-off with new material, tension tolerances occur only at a magnitude which permits the production of roving yarn of adequate quality. After the first pull-off, the memory contains the maximally adjusted nominal speed value for the rotational drive of the bobbin and the traverse drive of the bobbin carriage for each winding layer. During subsequent pull-offs, these nominal speed values are immediately available, and the regulating device has only the task of monitoring and precision-correcting.

The method permits, during material changes, the immediate continuation of production, without the requirement of additional times for re-equipment and sample pull-offs. The controls must only be supplied with the estimated material characteristic values and the production characteristic numbers. The advantage of this method is particularly beneficial for flyer frames for worsted yarn, which frames require frequent changes of material.

We claim:

1. A method of controlling a roving machine to regulate roving tension developed therein, said machine being of the kind having separate bobbin, bobbin carriage, flyer and stretching mechanism drive systems independent of one another and memory means in which are stored layer-dependent bobbin rotational speed nominal values, characterized in that said bobbin drive system is, during the bobbin winding of each roving layer, controlled to produce a bobbin rotational speed corresponding to the bobbin rotational speed nominal value then in storage for that roving layer; that, in respective production periods during which each roving layer is being laid down on a uniform bobbin diameter, i.e. on an established roving layer, a calculated adjustment value for optimizing roving tension is added to the layer-dependent bobbin rotational speed nominal value for the roving layer, and the sum is then considered as the new nominal value for that roving layer; that the difference between the last new nominal value and layer-dependent bobbin rotational speed nominal value for that roving layer is added to the layer-dependent bobbin rotational speed nominal value for the following roving layer, and the sum is stored in said memory means as the new layer-dependent bobbin rotational speed nominal value for said following roving layer; and that the last new nominal value for said following roving layer is stored in said memory means as the new layer-dependent bobbin rotational speed nominal value for that roving layer.

2. The method according to claim 1, characterized by the fact that the new layer-dependent bobbin rotational speed nominal values stored in said memory are utilized in subsequent runs of the roving machine in which substantially the same roving material is used.

3. The method according to claim 1 or 2, characterized by the fact that, for each roving layer, a nominal value coordinated with the last new layer-dependent bobbin rotational speed nominal value is calculated and memory stored for use in controlling said bobbin carriage drive system to produce corresponding bobbin carriage traversal speeds.

* * * * *